United States Patent [19]

O'Leary

[11] 4,154,150

[45] May 15, 1979

[54] CHIMNEY CLOSURE WITH DAMPER

[76] Inventor: Cornelius O'Leary, 342 Stanley Ave., Mamaroneck, N.Y. 10543

[21] Appl. No.: 804,986

[22] Filed: Jun. 9, 1977

[51] Int. Cl.[2] ..... F23L 17/02

[52] U.S. Cl. ..... 98/59; 126/120; 126/286; 126/288

[58] Field of Search ..... 126/286, 288, 120; 98/59

[56] References Cited

U.S. PATENT DOCUMENTS

| | | | |
|---|---|---|---|
| 1,407,351 | 2/1922 | Myers | 126/288 |
| 1,946,008 | 2/1934 | White | 126/288 |
| 2,665,683 | 1/1954 | Snook | 126/288 |
| 2,704,502 | 3/1955 | Rainey | 126/288 |
| 3,134,377 | 5/1964 | Kandy | 126/288 |
| 4,026,264 | 5/1977 | Henriques | 126/121 |

*Primary Examiner*—Henry C. Yuen
*Assistant Examiner*—Larry I. Schwartz
*Attorney, Agent, or Firm*—Spellman, Joel & Pelton

[57] ABSTRACT

A chimney closure is disclosed having a damper which consists of a pair of contiguous generally coplanar leaf sections pivotally mounted over the open end of a chimney. The leaf sections may be pivoted back and forth with respect to the plane of the chimney opening between generally horizontal and vertical positions. One of the leaf sections opens and closes approximately half of the chimney opening. The area of the other leaf section is less than that of the one section and, therefore, it only partially obstructs the remaining part of the opening when the one section is closed. The damper is carried by a casing which surrounds the chimney opening.

8 Claims, 3 Drawing Figures

CHIMNEY CLOSURE WITH DAMPER

The invention relates to chimney dampers and more particularly to an improved damper which is adapted for installation over the open end of a combination fireplace and furnace chimney partially to obstruct the opening. The damper is pivotally mounted to be moved relative to the plane of the opening between open and closed positions.

Heretofore, chimney dampers have been constructed to open and to close a chimney flue for the purpose of respectively permitting or blocking the flow of convection drafts therethrough. For example, chimney dampers have been employed above a fireplace to control heat loss through the fireplate flue. Where a chimney stack is also provided with a flue for an oil burner or the like, there has been little or no effective control over the passage of combustion or other convection gases. In some cases, this has resulted in an extensive draft through the heating system and its exhaust flue thereby minimizing the heating ability of combustion products originating in the furnace. Moreover, the draft established through the usual burner flue draws quantities of air across the furance to the outside even when the burner is turned off. Thus the boiler is unnecessarily cooled when the burner is off thereby requiring a longer firing time and consequent waste of fuel to heat the boiler to the desired temperature.

The present invention alleviates these problems in providing a damper which is mountable over the open end of the chimney and which closes a predetermined portion of the chimney opening thereby partially obstructing the convection flow of gases out of the chimney. The damper may be opened upon demand to increase the draft. Thus where a chimney accommodates both a fireplace and a furnace flue, the damper of the present invention limits the flow of exhaust gases when the fireplace is not being used and may be opened to increase the draft when the fireplace is being used. The resulting control over the exhaust capacity of the chimney permits efficient utilization of both the furnace and the fireplace.

SUMMARY OF THE INVENTION

The invention pertains to a device for controlling the flow of chimney flue currents and includes a pair of generally planar leaf sections mounted over the open end of the chimney and movable between positions opening and closing portions of the chimney opening. One of the leaf sections opens and closes approximately half of the chimney opening. The other leaf section partially obstructs the remaining part of the opening when the first leaf section is closed and obstructs less of the opening when the first leaf section is open.

DESCRIPTION OF THE DRAWINGS

For a further understanding of the present invention, reference may be had to the accompanying drawings, in which.

BRIEF DESCRIPTION OF THE PREFERRED EMBODIMENTS

Figure 1:
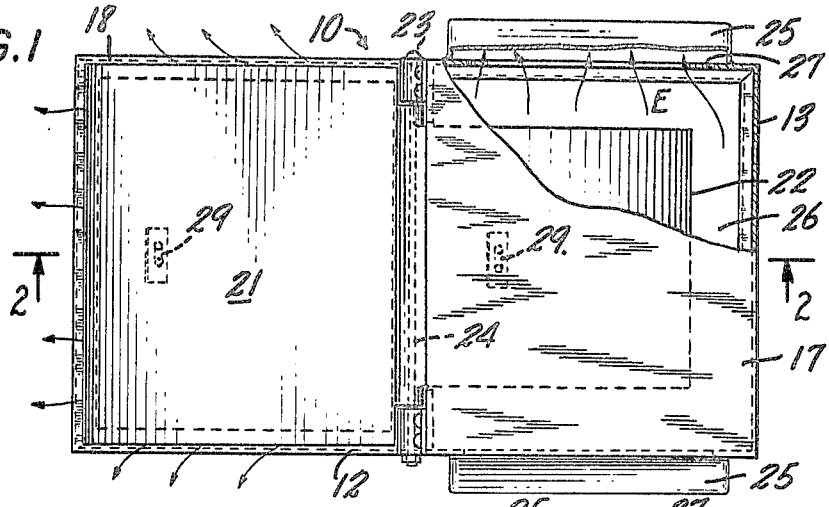
FIG. 1 is a plan view, partially in section, showing a chimney damper in accordance with the present invention mounted over a chimney opening.
Figure 2:
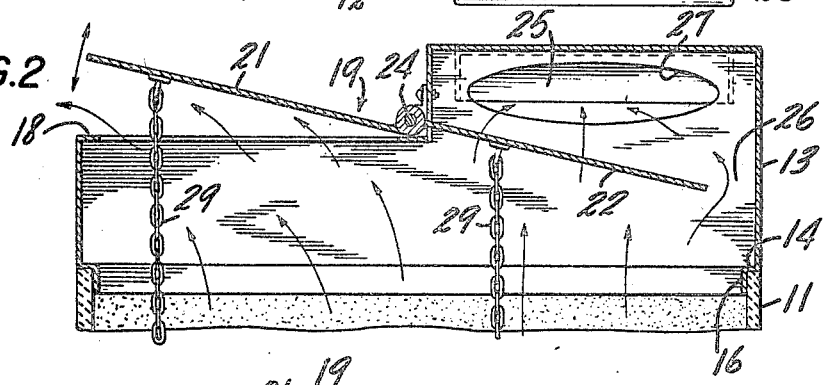
FIG. 2 is a view taken along the line 2—2 of FIG. 1.

Referring now to the drawings, and in particular to FIGS. 1 and 2, there is shown a chimney closure 10 adapted to be mounted over the open end of a chimney 11 for the purpose of regulating the flow of convection currents through the chimney flue. The closure includes a support or encasement 12 having upstanding sidewalls 13 surrounding the chimney opening and extending above the respective tops of the chimney walls defining the opening. In the present embodiment the encasement is generally boxlike, having four sidewalls each of which corresponds to one of the chimney walls. The encasement may be varied in size and shape, of course, to conform to various chimney configurations. The lower ends of the encasement sidewalls may be bent radially inwardly to define a generally flat peripheral base section 14 which rests or bears upon the upper end of the chimney. A peripheral lip of flange 16 depends from the base section 14 to fit concentrically within the chimney opening. The flange 16 is arranged to fit snugly against the inner sidewalls of the chimney to prevent lateral displacement of the closure from the top of the chimney. Of course, other techniques of securing the closure to the chimney may be employed without departing from the scope of the invention.

As shown in FIG. 2, the height of the sidewalls may vary along the length of the chimney opening so that the encasement actually appears somewhat shoelike in cross section, being higher over approximately half of the opening. This higher portion of the encasement is preferably covered with a flat plate 17 to serve as a rain shield and to provide additional control over the outward flow of chimney flue gases. The lower section of the encasement which surrounds the remaining part of the chimney opening, is open ended, the sidewalls being turned inwardly around their periphery to define a generally flat support flange 18 for a purpose described below.

The encasement 12 provides suitable frame support for a pivotally mounted damper plate 19 extending over the chimney opening. In the present embodiment, the damper consists of a pair of integral and substantially coplanar leaf sections 21 and 22 which are mounted across the chimney top so as to pivot toward and away from the plane of the chimney opening. The damper is connected to the encasement so as to pivot around an axis 23 situated between the leaf sections and characterized by an axle pin 24 extending from one side of the closure to the other. The pin 24 passes through a transverse bore formed in the damper. It should be understood that other suitable pivot connections may be utilized here without departing from the scope of the present invention. Moreover, while in this embodiment the pivot axis 23 bisects the chimney opening, the scope of the invention should not be so limited.

The leaf section 21 is large enough to cover the peripheral encasement flange 18 which thereby acts as a stop to restrain the pivotal movement of the leaf at a substantially horizontal closed position. The leaf 21, therefore, is able to cover and to close approximately half of the chimney opening. In this closed position, the leaf 21 and the cover plate 17 together cover the entire opening.

In accordance with the invention, the area of the leaf section 22 is less than that of the leaf section 21 and less than the area of the remaining part of the chimney opening. As shown in FIGS. 1 and 2, the periphery of the leaf section 22 is spaced inwardly from the inner adjacent sidewalls of the chimney thereby defining a generally U-shaped passage 26 through which convection currents may flow even when the leaf section 21 is in the closed position and the damper 19 is accordingly substantially horizontally oriented over the chimney opening. In this position the damper 19 obstructs the opening to its maximum permissible extent.

When the encasement 12 is provided with the cover plate 17, one or more of the sidewalls supporting the cover plate may be provided with an opening such as the opening 27 to enable combustion products to escape from the chimney flue when the damper is in its horizontal position. In this position, the damper and the encasement provide efficient control of combustion products resulting from an oil or gas fired residential furnace. It has been found that the draft effected by the average unobstructed chimney flue permits such a rapid expulsion of burner combustion gases that heat generated within the furnace passes out through the chimney too fast to enable efficient heat exchange activity in the boiler. Moreover, the draft continues when the burner is turned off thereby undesirably cooling the boiler between firings. When the damper is in its horizontal position, the leaf sections 21 and 22 obstruct the chimney opening and disrupt the draft. Convection currents passing through the chimney can only exit through the U-shaped passage 26 and the encasement opening 27 as illustrated by the arrows E in FIG. 1. Accordingly, a slight back pressure develops within the flue to enable more efficient heat exchange within the boiler when the burner is on, and minimizing boiler cooling when the burner is off.

When desired, a louver 25 may be connected to the external encasement sidewalls over each of the openings 27. The louver serves as a shield to deflect rain or wind away from the openings 27 or to impede the entry of debris from adjacent or overhanging trees.

If a wood fire is built in the fireplace 28 (FIG. 3) the obstruction of the flue must be reduced. In that event the damper 19 is simply tilted or pivoted to an open position as illustrated in FIG. 2. The degree of tilt may be varied as desired. The maximum opening occurs, of course, when the damper is oriented generally vertically with respect to the plane of the chimney opening.

Figure 3:
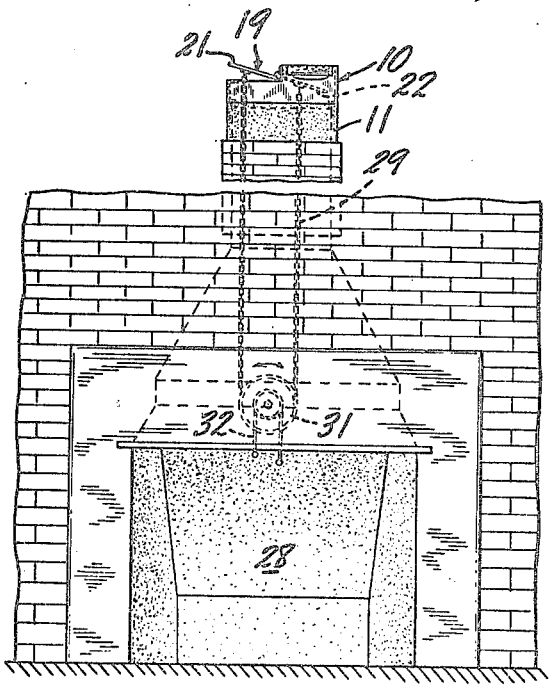
FIG. 3 is a cutaway side view of a fireplace and chimney provided with the damper of the present invention and showing a manual damper control.

The damper 19 may be pivoted with respect to the plane of the chimney opening by means of one or more chains 29, appropriately connected to the underside of the damper and hanging down to the vicinity of the fireplace for convenient access. If desired, the chain 29 may be looped around a suitable sprocket wheel 31 mounted within the chimney as shown in FIG. 3. In that event rotation of the sprocket wheel may be effected by a second chain 32, the free ends of which hang accessibly adjacent the fireplace opening. Movement of the sprocket wheel back and forth as indicated by the arrow F (FIG. 3) serves to open and close the damper at the top of the chimney.

Other changes and modifications will occur to those skilled in the art. It is therefore intended that the scope of the present invention is not to be limited except as defined by the following claims.

What is claimed is:

1. A device for controlling the flow of convection currents through an open-ended chimney, comprising:

a support cover for mounting over the open end of the chimney said cover having a first opening and a second opening and carrying a first vane leaf section movable between positions opening and closing the first said opening and a second vane leaf section only partially obstructing the second said opening when said leaf section is closed and obstructing a smaller part of the second opening when said first leaf section is open thereby to interrupt the flow of convection currents through the first said opening and to permit a respectively greater or lesser flow of convection currents through the second said opening of the cover.

2. The device of claim 1 in which the vane leaf sections are mounted on the support between said openings so as to pivot toward and away from the plane of the chimney opening.

3. The device of claim 2 in which the vane leaf sections pivot simultaneously and respectively relative to the chimney openings.

4. The device of claim 3 in which the area of said second leaf section in the plane of the opening is less than the area of said second opening.

5. The device of claim 4 in which the perimeter of said second leaf section is spaced inwardly from that of the second said opening.

6. The device of claim 5 in which said leaf sections are interconnected so as to pivot between the said openings and on the same axis.

7. The device of claim 6 in which said leaf sections are inter-connected at the axis so as to form a generally flat unitary damper member.

8. The device of claim 7 in which the area of said first leaf section in the plane of the first said opening is greater than the area of said second leaf section in the plane of the second said opening.

* * * * *